US006827094B1

(12) United States Patent
Bramwells

(10) Patent No.: US 6,827,094 B1
(45) Date of Patent: Dec. 7, 2004

(54) SHIELDING ASSEMBLY

(76) Inventor: Hugh William Bramwells, 3 Rose Street, Highett, Victoria 3190 (AU)

( * ) Notice: Subject to any disclaimer, the term of this patent is extended or adjusted under 35 U.S.C. 154(b) by 0 days.

(21) Appl. No.: 09/936,605

(22) PCT Filed: Mar. 17, 2000

(86) PCT No.: PCT/AU00/00203

§ 371 (c)(1),
(2), (4) Date: Sep. 14, 2001

(87) PCT Pub. No.: WO00/55456

PCT Pub. Date: Sep. 21, 2000

(30) Foreign Application Priority Data

Mar. 17, 1999 (AU) ..... PP9280

(51) Int. Cl.[7] ..... E04H 15/00
(52) U.S. Cl. ..... 135/120.1; 135/115
(58) Field of Search ..... 135/90, 115, 117, 135/118, 119, 120.1, 900, 120.2, 120.3, 121, 155, 129, 901; 52/2.19

(56) References Cited

U.S. PATENT DOCUMENTS

| | | | | |
|---|---|---|---|---|
| 2,036,033 A | | 3/1936 | Fisher | 135/118 X |
| 2,598,588 A | | 5/1952 | Mullen | 135/118 X |
| 4,506,688 A | | 3/1985 | Bethoon et al. | 135/120.1 X |
| 4,833,837 A | | 5/1989 | Bonneau | 52/2.19 |
| 5,080,123 A | * | 1/1992 | Stein | 135/97 |
| 5,277,214 A | | 1/1994 | Tolley | 135/115 X |
| 5,927,311 A | * | 7/1999 | Jager | 135/124 |

FOREIGN PATENT DOCUMENTS

| | | |
|---|---|---|
| EP | 260771 | 3/1988 |
| EP | 691445 | 1/1996 |

* cited by examiner

*Primary Examiner*—James O. Hansen
(74) *Attorney, Agent, or Firm*—Dorsey & Whitney LLP

(57) ABSTRACT

A shielding assembly includes at least first and second elongate members and a shield movably mountable adjacent the shielding assembly. Each of the members are joinable together at a common point. The shield is movable in three dimensions relative to the shielding assembly so as to shield a user of the shielding assembly.

4 Claims, 12 Drawing Sheets

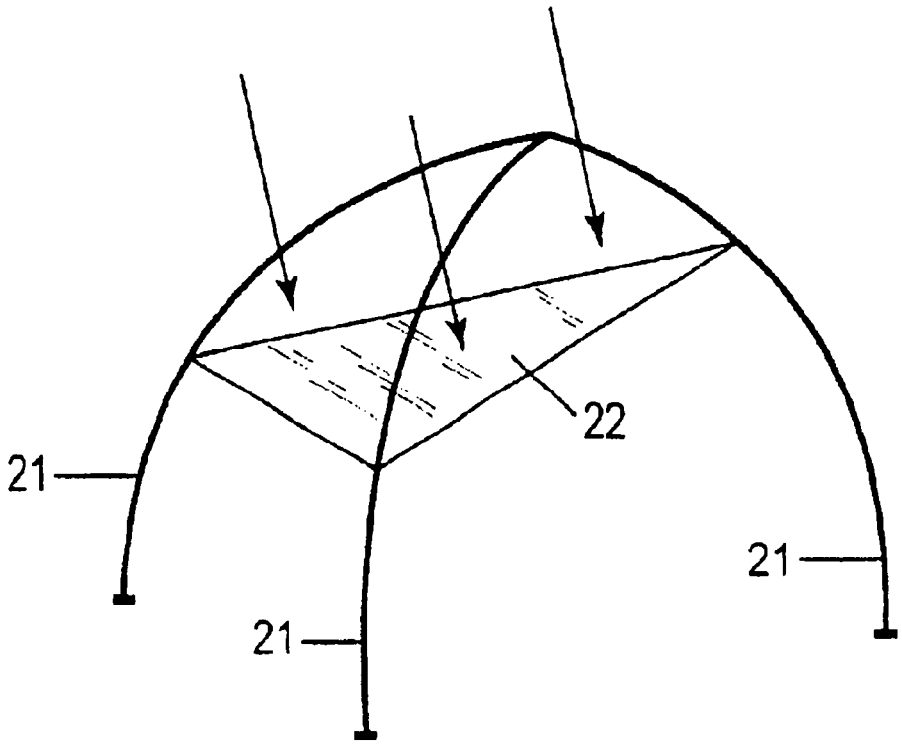
FIG 2
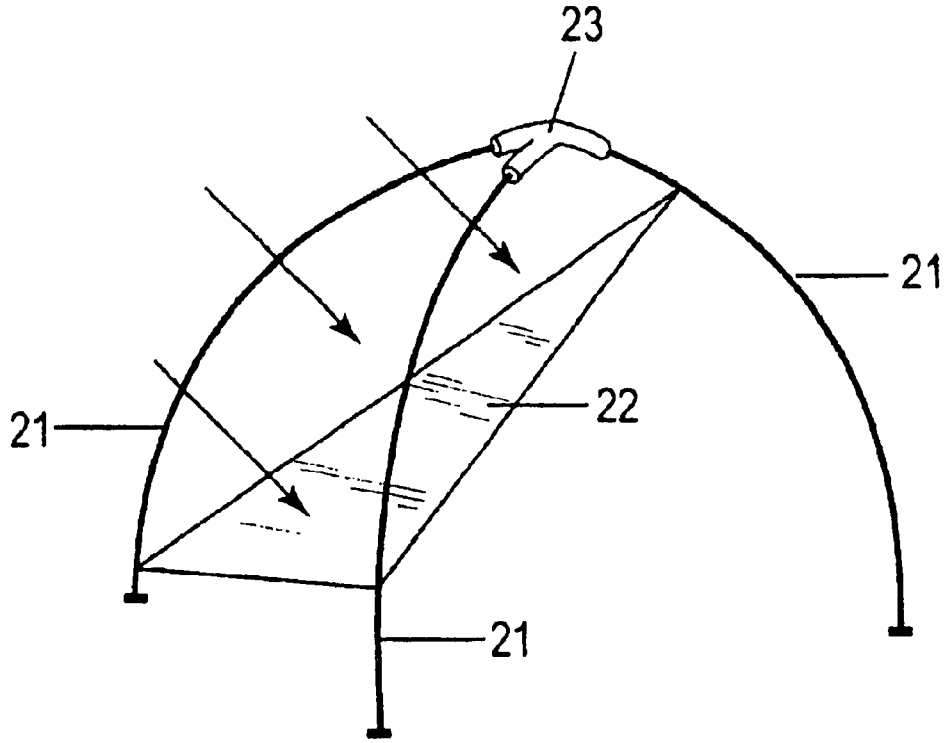

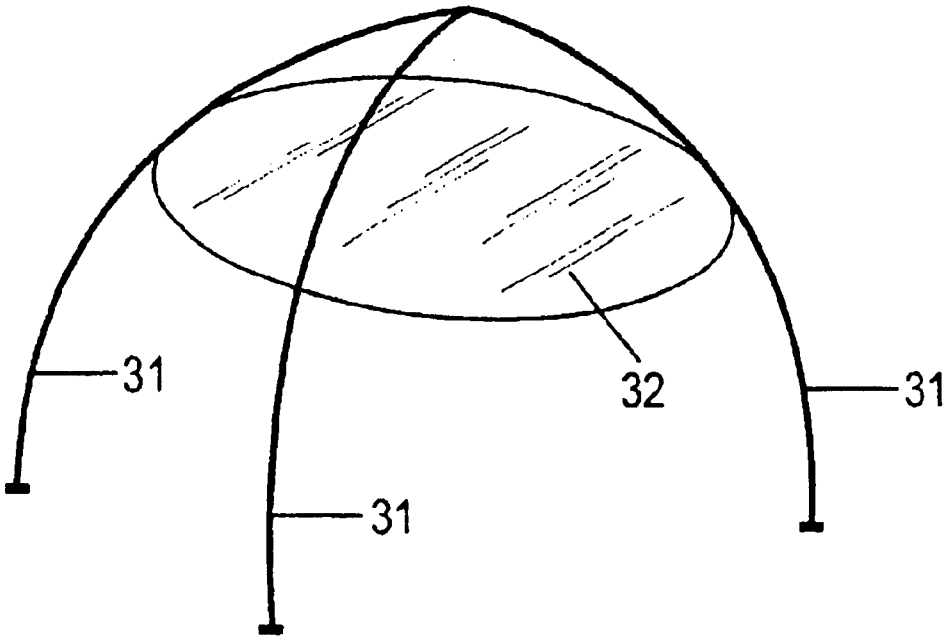
FIG 3
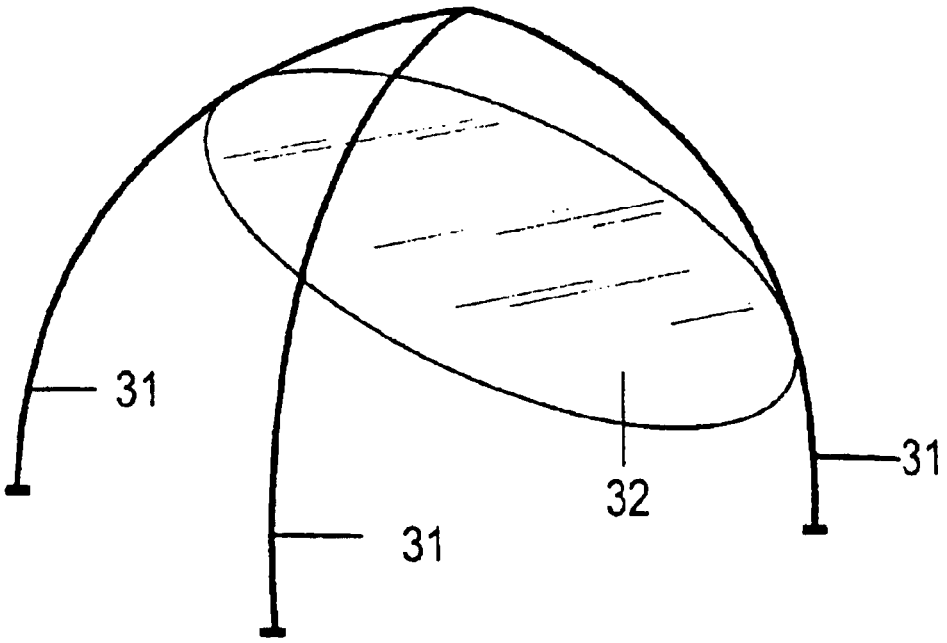

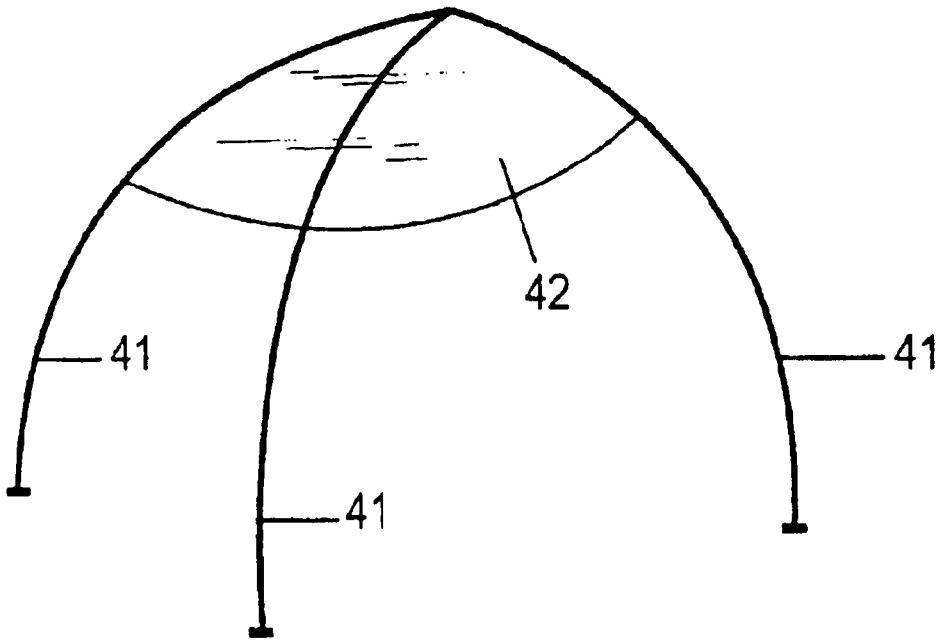
FIG 4
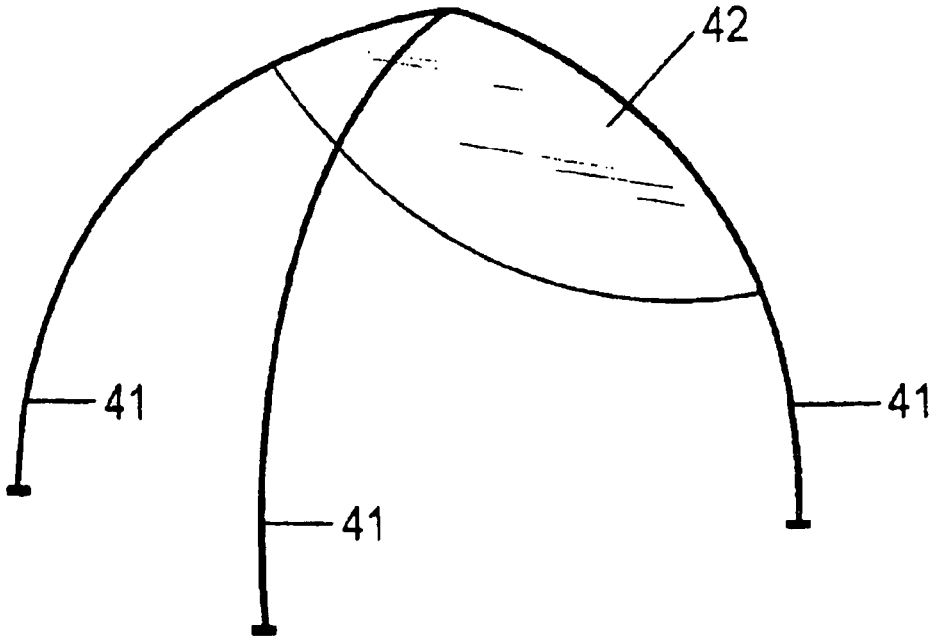

FIG 9
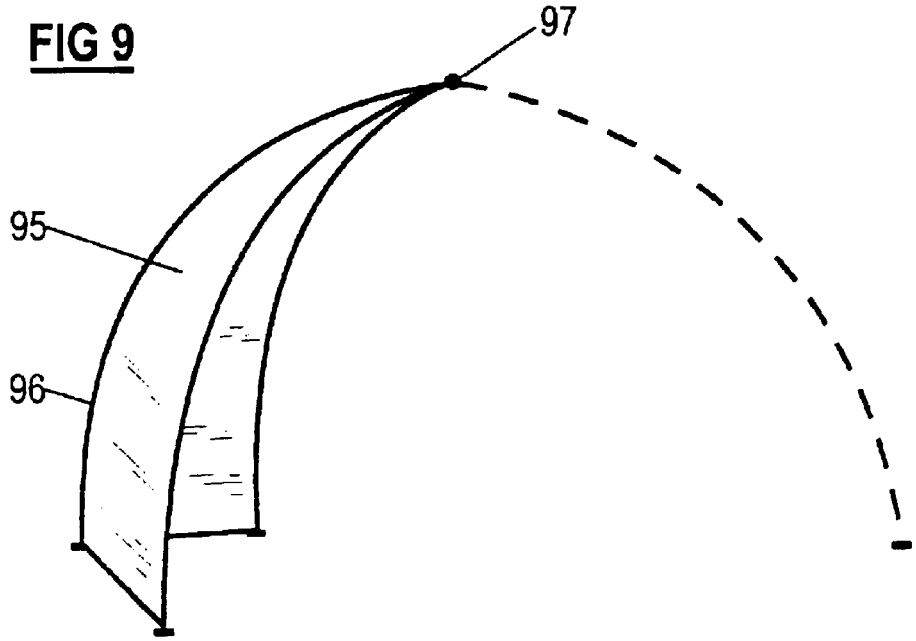
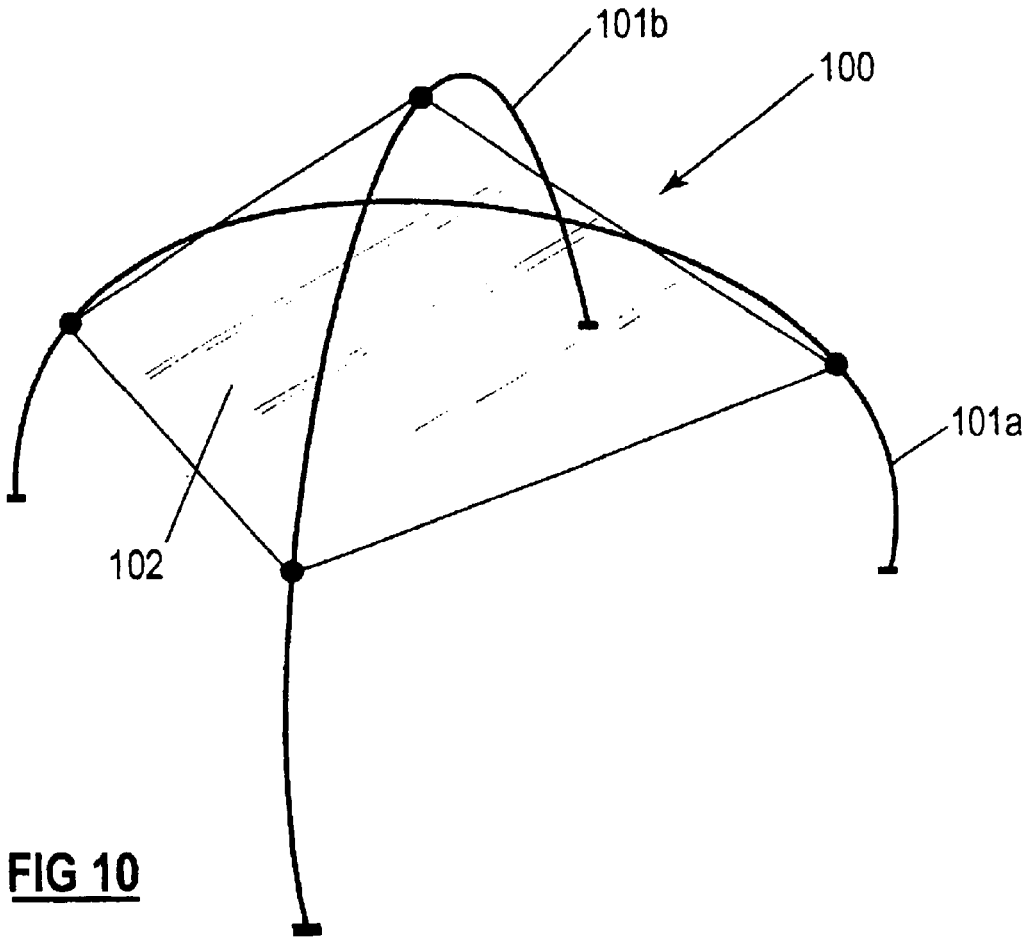
FIG 10

FIG 11 (ii)

FIG 11 (iii)

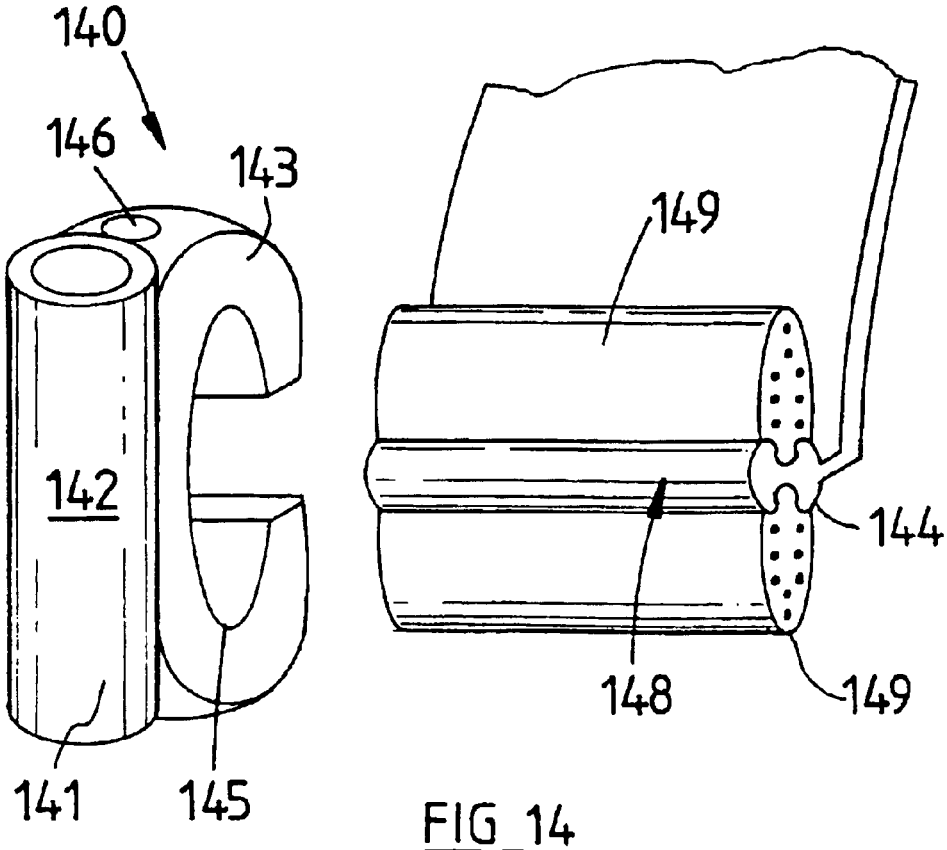
FIG 14
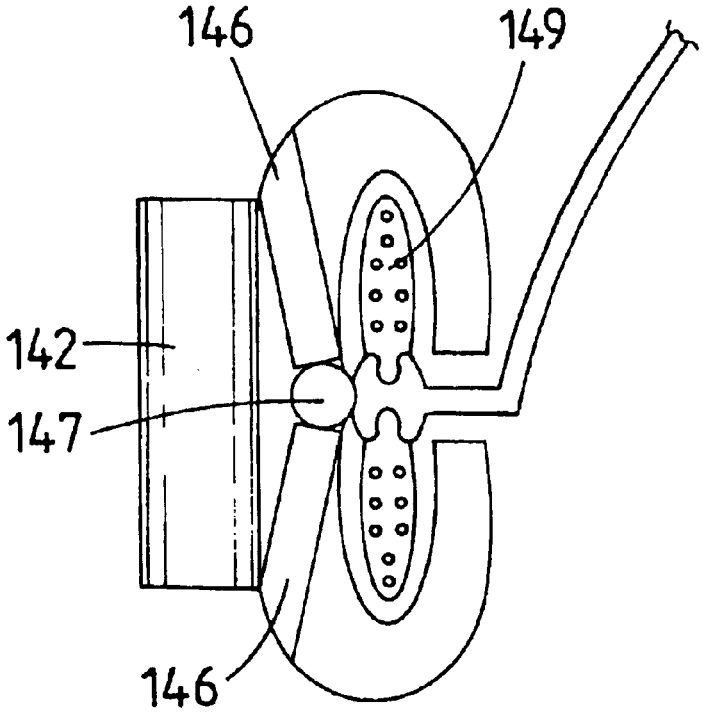

SHIELDING ASSEMBLY

BACKGROUND OF THE INVENTION

1. Field of the Invention

The present invention relates to a shielding assembly. In particular, the invention relates to a shielding assembly which is adapted to shield a user or users from sun and/or wind.

2. Description of the Related Art

Conventionally, protection from the sun or wind has been generally achieved using temporary or permanent structures such as umbrellas, gazebos, marquees and sails. In all of these arrangements the assembly is substantially static and, as such, they are prone to allowing sunlight through to the area intended to be covered and protected on movement of the sun.

BRIEF SUMMARY OF THE INVENTION

The invention advantageously provides an assembly which is adjustable to shield a user from the sun under various conditions, and which optionally may also provide shielding from wind. The shielding from the wind is advantageously independent of the sun shielding operation of the assembly. The invention advantageously has extremely broad application providing not only temporary assemblies for use, for example, on the beach or in a picnic area, but also permanent structures which cover, for example, swimming pools, playgrounds, dining areas or the like.

According to the present invention there is provided a shielding assembly comprising:

a shield for shielding a user of the assembly; and a support for supporting said shield, the support including at least one elongate member relative to which said shield is moveably mounted;

wherein movement of said shield relative to the at least one elongate member, optionally in combination with movement of one or more of said elongate members, facilitates three-dimensional movement of the shield about a defined region below said at least one elongate member, the three-dimensional movement including a vertical component, a longitudinal component and a lateral component.

As used herein, three-dimensional movement including vertical, longitudinal and lateral components refers to movement of the shield which can be broken down into three components corresponding to the X, Y and Z axis of movement.

The support, shield and the mounting of the shield relative to the support may take any suitable configuration. In particular, the support may comprise any suitable number of elongate members, the shield may be of any suitable shape or size, and the mounting of the shield may include any suitable mounting provided that the movement of the shield, optionally in combination with movement of one or more of the elongate members facilitates three-dimensional movement of the shield about a defined region below the at least one elongate member.

In one embodiment the support includes a single elongate member, preferably in the form of an arch support, or a pair of elongate members, and the shield is mounted for longitudinal movement relative to the elongate member, for example such that the shield can track along the elongate member to provide optimal shielding from the sun. In this embodiment, the shield may be mounted on the inner or outer surface of the elongate member. Further, the elongate member may be adapted to be pivotally mounted at at least one end thereof to facilitate transverse movement of the elongate member, and therefore the shield relative to the longitudinal plane of the elongate member. Alternatively, the shield may be mounted for transverse movement relative to the elongate member itself. Further, the shield is preferably mounted such that it is lockable relative to the elongate member.

Where the elongate member is pivotally mounted at only one end thereof, this mounting may be, for example, on a wall the other end of the elongate member being mounted for tracking relative to the ground. Conversely, the elongate member may be pivotally mounted to the ground at one end and mounted for tracking relative to a wall at the other. Alternatively, both ends of the elongate member may be pivotally mounted relative to the ground so that the member may tilt about an axis defined by the ends thereof.

According to this embodiment, as stated above, the shield may be mounted relative to the elongate member by any suitable means. The mounting may, for example, comprise a single point of contact between the shield and the elongate member, or may comprise a plurality of points of contact or a track on the shield which runs along the elongate member. Other alternatives will be readily ascertained and determined by those skilled in the art. Further attachments may also be provided for additional shielding, for example from wind, or to provide netting to protect a user from insects.

According to another embodiment, the support includes a fixed member and an articulated arm pivotally mounted to the fixed member, the shield being mounted for longitudinal movement relative to the articulated arm. In this embodiment, the fixed member may take any suitable form, but advantageously includes a strut from which the articulated arm hangs. As such, the articulated arm is rotatable around 360° and the shield is movable, for example by tracking as previously discussed, along the length of the articulated arm. Alternatively, the articulated arm itself may be not only pivotally mounted relative to the fixed member, but also may be mounted such that the pivot point of the fixed member tracks along the articulated arm.

According to a further embodiment, the support includes a fixed elongate member and a moveable elongate member mounted for longitudinal movement relative to the fixed elongate member, the shield being mounted for longitudinal movement relative to the moveable elongate member. Preferably in this case, the moveable elongate member is mounted such that it tracks along the fixed elongate member, the fixed elongate member being in the form of an arch and the moveable elongate member being in the form of an incomplete arch, and the shield is mounted for tracking along the moveable elongate member. Each end of the fixed elongate member is advantageously secured to the ground, as is the distal end of the moveable elongate member, although the distal end of the moveable elongate member is pivotally mounted relative to the ground to facilitate tracking of the moveable elongate member along the fixed elongate member.

In still a further embodiment, the support includes two elongate members mounted at about 90° to each other, each of the elongate members being pivotally mounted at each end thereof for longitudinal pivotal movement relative to the other elongate member, the shield being mounted for longitudinal movement relative to each of the elongate members.

The two elongate members in this case generally comprise a pair of arch supports which are positionable at about 90° to each other, and which are movable relative to each other. This may be achieved using two separate and individual arch supports, or a single continuous loop which is constructed to provide a cross arrangement. The shield is mounted on each of the arch supports, each of the supports being moveable relative to, and substantially around the axis of, the other support. In this case, therefore, the shield is moveably mounted relative to each of the individual arch supports. It will be understood that both supports may be moved simultaneously if desired to reposition the shield.

According to still a further embodiment of the invention the assembly is operable between a collapsed orientation and an assembled orientation, wherein in the collapsed orientation the support includes a pair of concentric members an inner member of which mounts the shield, the concentric members being moveable to an intermediate orientation wherein the concentric members are oriented at about 90° to each other, and from the intermediate orientation to the assembled orientation wherein lower potions of the concentric members are compressed to provide a base for the support, the shield being supported within the support when the assembly is in the assembled orientation.

In this embodiment, the shield and the concentric members, in the collapsed orientation, may be secured to each other as desired, but are preferably secured by a suitable locking mechanism. Similarly, in the assembled orientation the concentric members and shield may be maintained in place by any suitable means. For example, the concentric members may be locked together in their assembled orientation at their points of contact, the assembled concentric members being oriented at about 90° relative to each other, and the shield secured to the concentric members within the formed support.

In a further embodiment, the support includes a plurality of pivotally mounted elongate members and a pivotally mounted central mounting member extending from a proximal end of a substantially upright strut, the shield extending over said support and being movably mounted relative to each of the elongate members and centrally fixedly mounted relative to the central mounting member.

Still further, the support may include a support strut having an elongate member extending therefrom, the shield being pivotally mounted relative to a distal end of the elongate member and including a plurality of lateral tracking means which are movable relative to the distal end of the elongate member. For example, the tracking means may include a plurality of laterally extending ridges relative to which the distal end of the elongate member is moveably mounted.

According to another embodiment, the support means comprises at least three support struts forming a frame, the shield being movably mounted within or outside the frame.

Taking, for example, an arrangement where the support means comprises three struts, the shield may comprise a triangular shield, each corner of which is adapted to run along a respective strut. Alternatively, one or each of the corners may be detachable and reattachable to a respective strut. This arrangement may also hold true for a circular or elliptical shield having three points of contact which contact a respective strut, and which are moveable along that strut and/or detachable and attachable to that strut. In yet another alternative, the shield may comprise a convex dome which is moveable within the struts of the support as desired. It will be recognised that in this embodiment, the material of the shield may necessarily be elasticised to ensure that movement of the shield is possible. For example, if the shield is triangular as two points of the triangular sheet are moved down two respective struts, the distance between the struts increases, thus the material must expand. Alternatively, taking this same example, each of the corners of the triangular sheet may be attached to an elastic cord which is in turn attached to the respective struts. In this case the triangular sheet could remain static, and the elastic cords extend as moved down the struts. Other alternatives will be readily determined by those skilled in the art.

Preferably, according to some embodiments, the shield is rotatable around its circumference which is, as described in the preceding paragraphs, lockable with respect to one or more of the struts of the support.

According to this embodiment, the shield, be it triangular, circular, elliptical or convex, may also be hung from the support beams, preferably using a wiring and/or pulley system such that a user of the assembly can alter the orientation of the shield with minimal effort. In this case, there is advantageously further provided means for retaining the shield in the desired position as set by the user of the assembly.

The struts of the support are preferably flexible, and may be tapered toward the top of the assembly to provide greater curvature. Furthermore, the struts may be connected at the top of the support by a joiner. For example, in the case of a three-strut support, the joiner would be a "Y-shaped" joiner. Advantageously, for storage purposes, the struts may fold into two or more segments, for example, as is the case in conventional tent poles.

In a preferred embodiment, the shielding assembly, be it configured as described in any one of the above embodiments, comprises a wind shield means. This may be integral with the assembly, or may be an additional attachment to the assembly, depending on the configuration of the assembly. For example, if the assembly comprises 3 or more struts, the wind shield means may comprise a shield which is mounted between the lower portions of the struts around at least a part of the outer perimeter of the shelter. According to this embodiment, the wind shield may comprise pockets for receiving, for example, sand or water which stabilises the wind shield and/or assembly.

In a preferred embodiment, the wind shield means comprises a wind shield which is moveably mounted, or which is mountable, relative to the shielding assembly, such that its position can be altered depending on the direction of the wind. For example, the wind shield may comprise a triangular arch which is attached to the shielding assembly at a point, and which is rotatable about the outer perimeter of the assembly. Preferably, the wind shield comprises locking means for locking the windshield in a position relative to the shielding assembly. Further, in certain embodiments the attachment of the shield may comprise an extended spine which is adapted to be slidably attached to the assembly, or which alternatively is independent of the assembly.

When the wind shield comprises a triangular arch, this preferably includes a longitudinal spine which is substantially central to the windshield. When in this configuration, in use the shield may be positioned such that the spine faces the prevailing wind, and thereby forms a more efficient wind break to the user of the assembly. In particular, the tapered sides and curvature of the shield arch advantageously such that optimal deflection of the wind is achieved. The wind shield, in a preferred embodiment, includes an upper circular opening which is positionable over the top of the shielding assembly to provide independent movement of the wind shield.

The shielding assembly may be secured to the ground by any suitable means. This may be somewhat dependent on the particular configuration of the support. For example, if the support comprises a single arch support, it may be necessary to secure the assembly using guy wires attached to the arch support. If the support comprises 3 or more struts, it may be more suitable to provide bags on each foot of the struts, the bag being adapted to receive, for example, sand or water. These and other means of securing the shielding assembly will be readily ascertained by a person in the art.

The assembly may also comprise additional attachments such as a canopy for protection from rain, or netting for protection from insects. Furthermore, a flow may be provided in various embodiments of the assembly.

For ease of assembly, as briefly mentioned above, the arch support(s) of each of the above embodiments are preferably adapted too be assembled using an internal pull-cord or elastic cords, or may be constructed to facilitate spring-loaded assembly.

Particular embodiments of the present invention will now be described with reference to the accompanying drawings in which:

BRIEF DESCRIPTION OF THE SEVERAL VIEWS OF THE DRAWINGS

FIG. 2 illustrates an alternative embodiment of the shielding assembly having three support struts which form a frame;

FIG. 3 illustrates an alternative configuration to the embodiment shown in FIG. 2;

FIG. 4 illustrates an alternate configuration of the shielding assembly shown in FIG. 2;

FIG. 9 illustrates the wind shield shown in FIG. 8;

FIG. 10 illustrates an alternate shielding assembly having two elongate members which are moveable relative to each other;

FIG. 14 illustrates a preferred locking mechanism for locking of the shield relative to the support.

DETAILED DESCRIPTION OF THE INVENTION

Figure 1A:
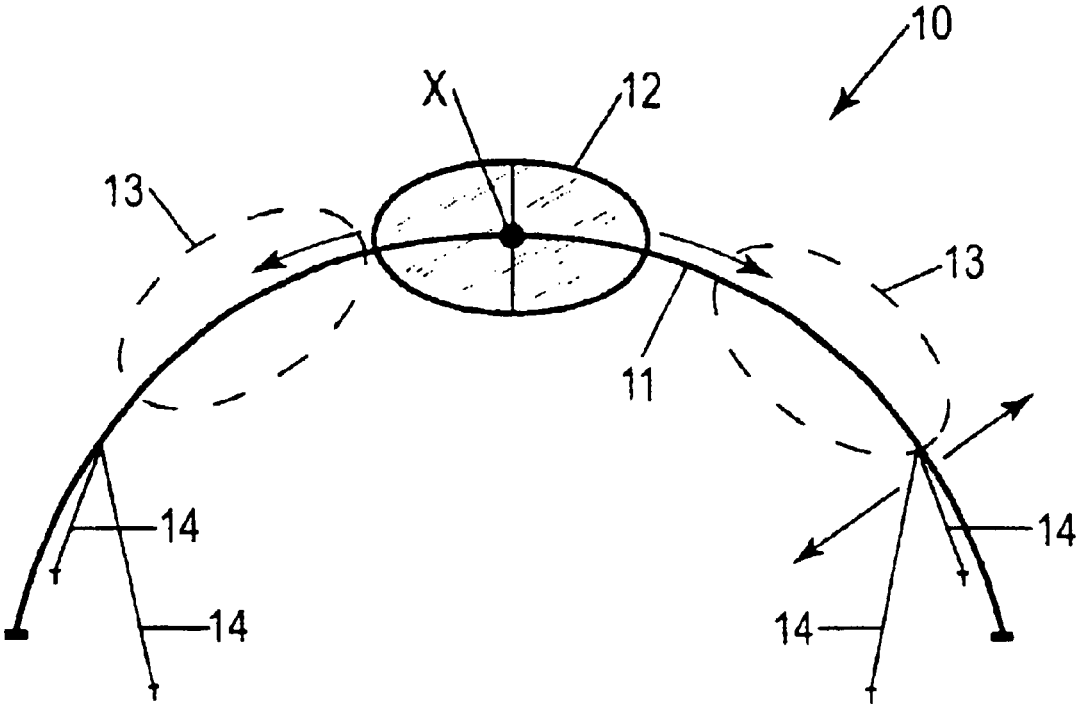
FIGS. 1A to 1D illustrate embodiments of the shielding assembly having a single elongate member.

Referring to FIGS. 1A to 1D, the shielding assembly 10 comprises a single arch 30 support 11, on which is mounted a shield 12. The shield 12 is mounted on the support 11 at point X. This mounting is such that the shield 12 is moveable along the support 11 as shown by the phantom shields 13. As such, the shield 12 is moveable, and lockable, along the length of the support 11. The shield 12 may be provided with a cross bar, the shield 12 being mounted on the support 11 via the cross bar, and the cross bar tracks along the support 11.

Figure 1B:
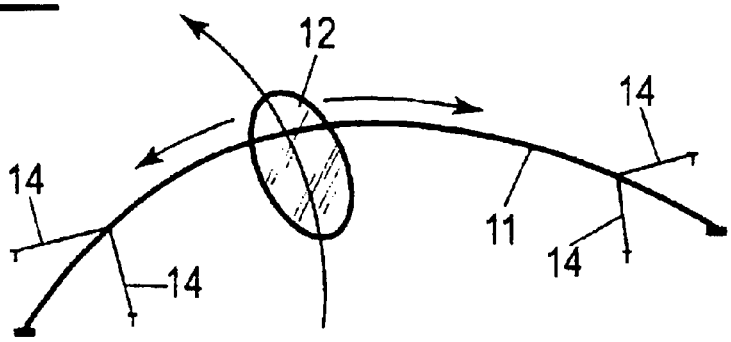
Figure 1C:
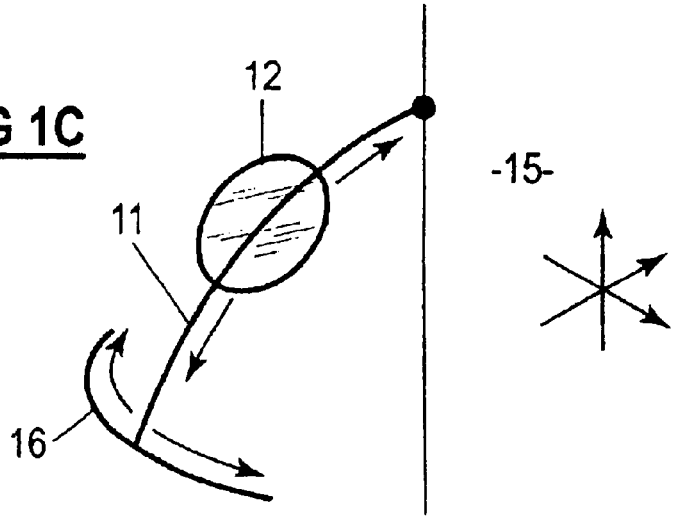
Figure 1D:
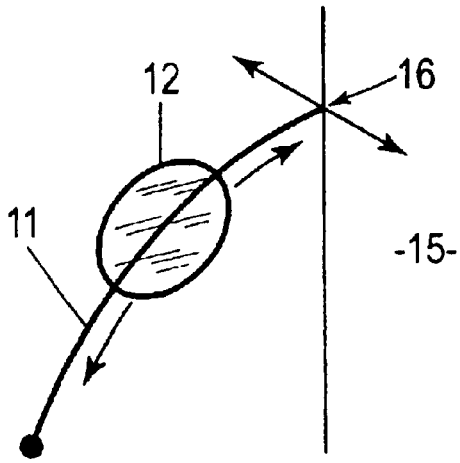

The support 11 in FIGS. 1A and 1B is secured to the ground by guy wires 14. The support 11 in FIG. 1A may be tilted toward the ground by adjusting the guide wires 14 such that the shield 12 may be moved relative to the support 11 at a suitable elevation from the ground relative to the suns elevation in the sky. As the operation of this embodiment will be simplified if the axis of the support is aligned with the path of the sun, the assembly may also be provided with a compass to facilitate optimal orientation in setting up of the assembly relative to the suns path. Alternatively as illustrated in FIG. 1B, the shield 12 may be mounted for transverse movement relative to the support 11 to account for the suns elevation in the sky., Referring to FIGS. 1C and 1D, the single arch support 11 may be pivotally mounted relative to a point on a wall 15 and mounted for tracking along the ground on a mounting 16. Conversely, as illustrated in FIG. 1D, the arch support 11 may be pivotally mounted relative to the ground and mounted for tracking along a mount on the wall 15. In these embodiments, it will be understood that a user of the assembly may be protected by the shield in the region defined by the movement of the support 11 along the mount 16 and the movement of the shield 12 along the support 11.

It will be understood that the assembly illustrated in FIGS. 1A to 1D may also comprise a pair of parallel supports, optionally joined at each end to provide additional support and strength to the assembly. Further, additional arches may provide support for other desirable features, such as a netting shield. In this embodiment, the shield may be detachable and mountable on any of the arches, including the additional arches.

Figure 1E:
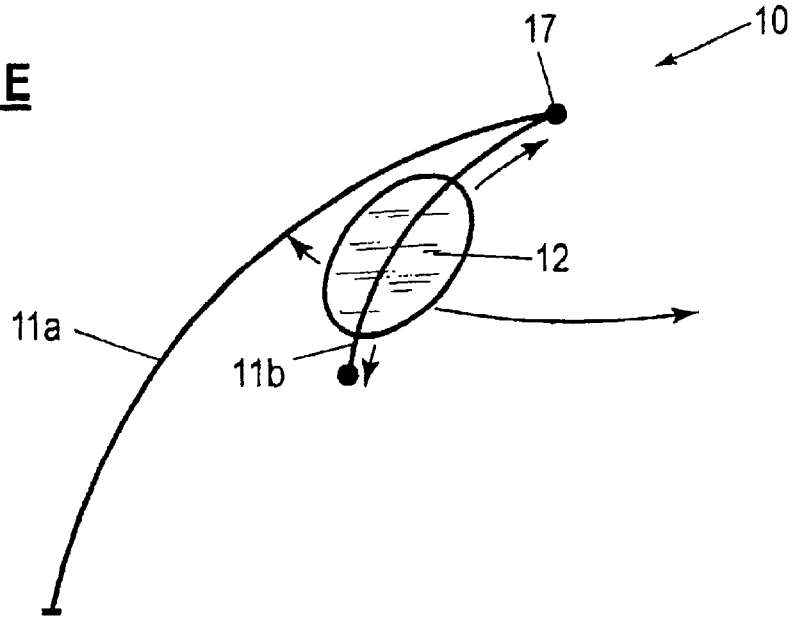
FIG. 1E illustrates an embodiment of the shielding assembly having a fixed member and a reticulating arm.
Figure 1F:
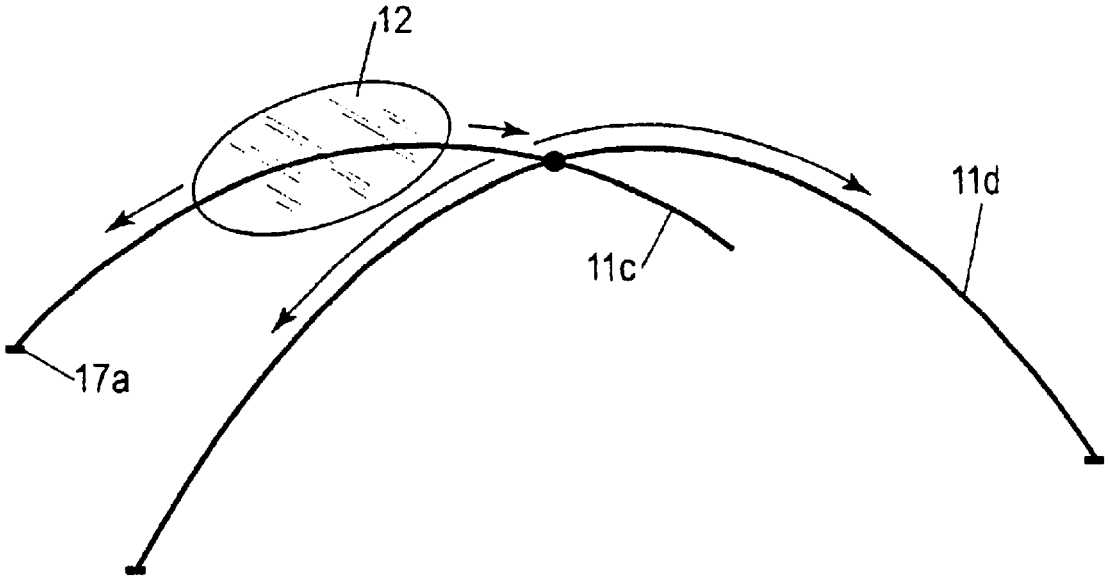
FIG. 1F illustrates an alternative embodiment of the shielding assembly having a single moveable elongate member and a fixed elongate member.

FIG. 1E illustrates a shielding assembly 10 which includes a fixed support strut 11*a* having a pivot 17 from which depends a pivotally mounted articulated arm 11*b*. The arm 11*b* is pivotally mounted for movement about 360° and has mounted thereon a shield 12. The shield 12 is mounted for longitudinal movement along the arm 11*b*. Alternatively, as illustrated in FIG. 1F, the shield is mounted on a moveable elongate member 11*c* which is mounted for tracking movement along a fixed member 11*d*. A shield 12 is mounted on the member 11*c* and is moveable along the length of the member 11*c*. As such, the moveable member 11*c* is pivotally secured at pivot point 17*a* to facilitate pivotal movement of the member 11*c* and tracking of the member 11*c* along the fixed member 11*d*.

FIG. 2 illustrates a shielding assembly 20 which comprises three strut supports 21, each of which is secured to the ground by any suitable means, for example a sandbag tied to the base of each strut 21. The shield 22 comprises a triangular sheet which is attached to each of the struts 21 at the points of the triangular shield 22. The connection between the shield 22 and each of the struts 21 may be such that the points of the shield are moveable relative to each of the respective struts, or may be detachable and reattachable to respective struts. As such, the shield 22 is moveable relative to the struts 21 so that it may be positionable taking into consideration the position of the sun in the sky (the incident rays of the sun being shown by arrows in FIG. 2).

It will be recognised that the shield 22 material in this example will necessarily be elastic to facilitate movement of the shield up and down the struts 21.

The struts 21 are joined by a connection 23 at the top of the assembly 20. This may be a separate connector, or may simply be a hinge to which each of the struts 21 is hingedly attached. Furthermore, the connector 23 and struts 21 may be configured such that the assembly 20 can be erected automatically by releasing a spring loaded system. The struts 21 may alternatively each have an internal cord, each of the cords being connected to a single pull-cord. In this case, on pulling the pull-cord, the assembly may be erected by activating each of the individual cords of respective struts.

FIG. 3 illustrates the embodiment of FIG. 2, but has a circular shield 32 rather than the triangular shield 22 illustrated in FIG. 2. In this case, the attachment of the shield 32 to struts 31 is advantageously such that a degree of rotational movement of the shield 32 about the struts 31 is facilitated. Similarly, FIG. 4 illustrates an embodiment where the shield 42 is a convex shield.

Figure 5:
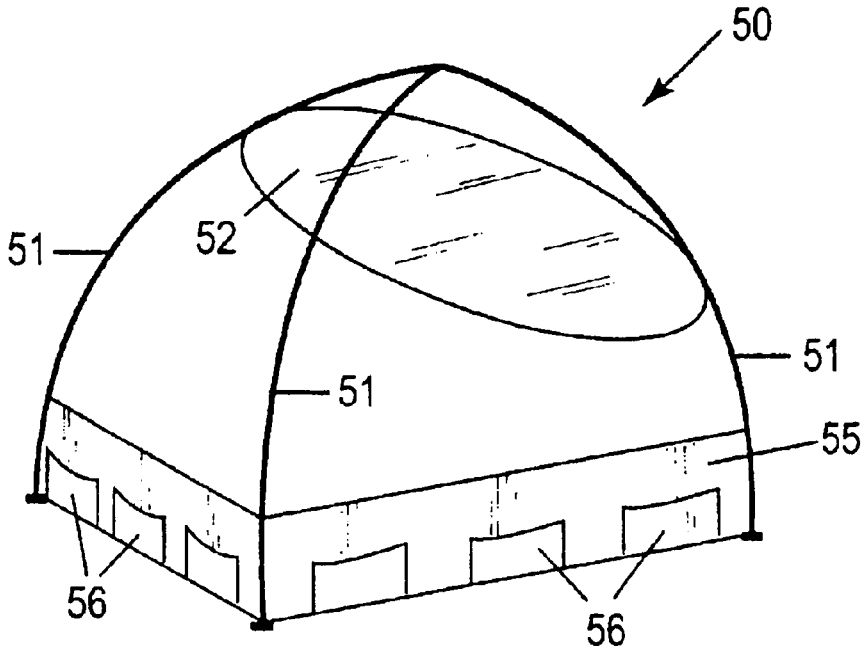
FIG. 5 illustrates the shielding assembly shown in FIG. 3 including a wind shield.
Figure 6:
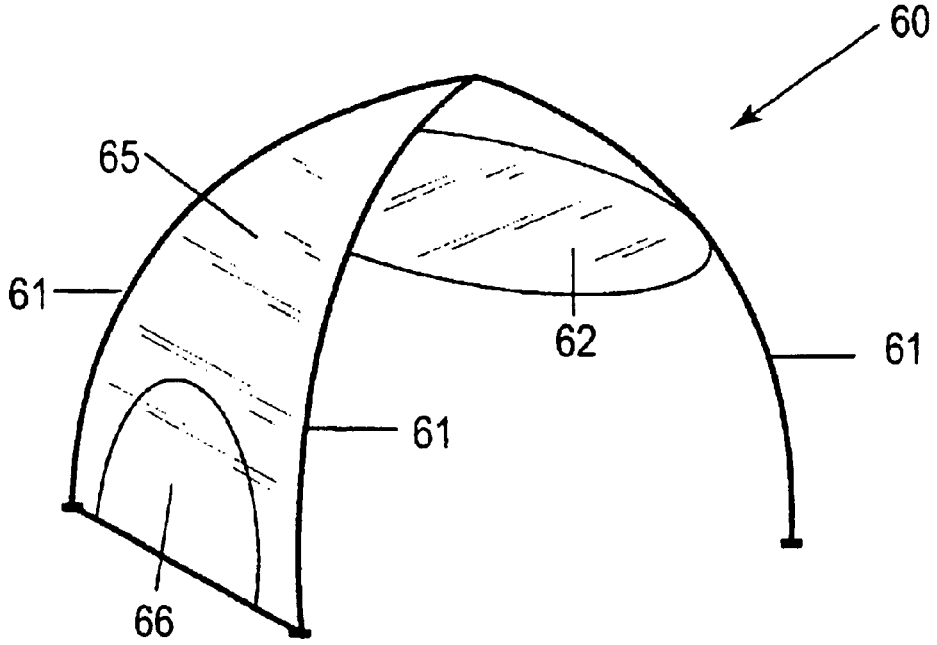
FIG. 6 illustrates the shielding assembly shown in FIG. 3 including an alternate wind shield.

FIGS. 5 and 6 illustrate the shield assembly of FIG. 3, but additionally include a wind shield 55 and 65 respectively. The wind shield 55 illustrated in FIG. 5 extends between the struts 51 of the shielding assembly 50. The wind shield 55 is illustrated as extending between two faces of the assembly 50, but may also suitably extend on only one face, or on all three faces of the assembly 50. The wind shield 55 further advantageously includes pockets 56, for example for receiving sand when the assembly 50 is used on the beach. The wind shield 65 shown in FIG. 6 extends between two struts 61, and covers an entire face of the assembly 60. The wind shield 65 may extend over two faces if desired, and may be provided with a fold down zipped door 66 if desired.

Figure 7:
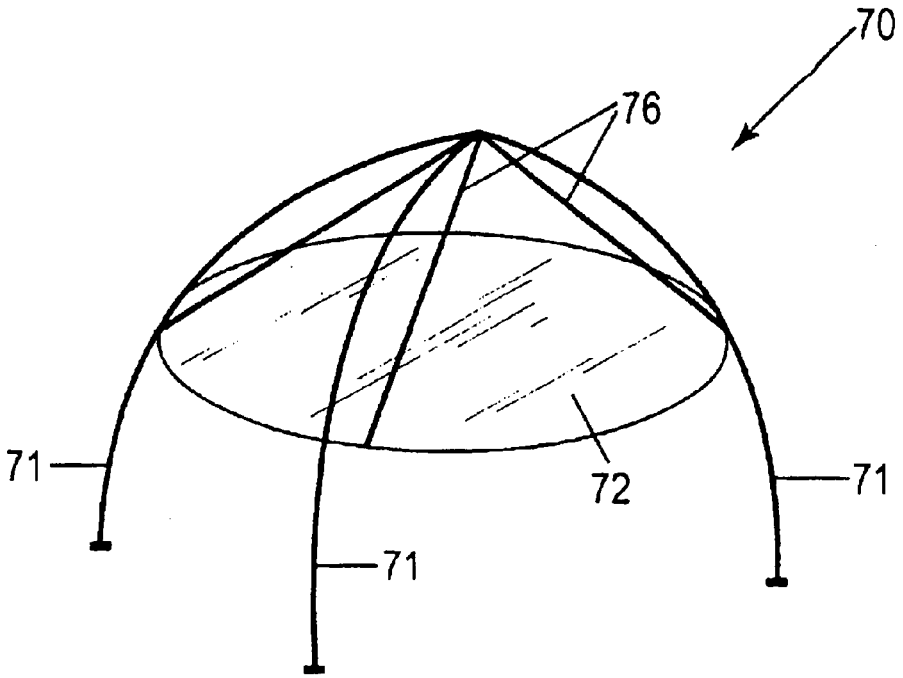
FIG. 7 illustrates a further alternate configuration of the embodiment shown in FIG. 2.

Referring to FIG. 7, the shield 72 may be hung from the assembly 70 by means of a support system 76, for example a pulley system. As such, the actual shield 72 may be mounted to the assembly 70 indirectly by the support system 76. The support assembly 76 is such that the orientation of the shield 72 relative to the struts 71 which support the assembly 76 may be altered as desired in accordance with the discussion above. Furthermore, points of the shield 72 may be attached to respective struts 71 when the shield 72 is in a desired orientation.

Figure 8:
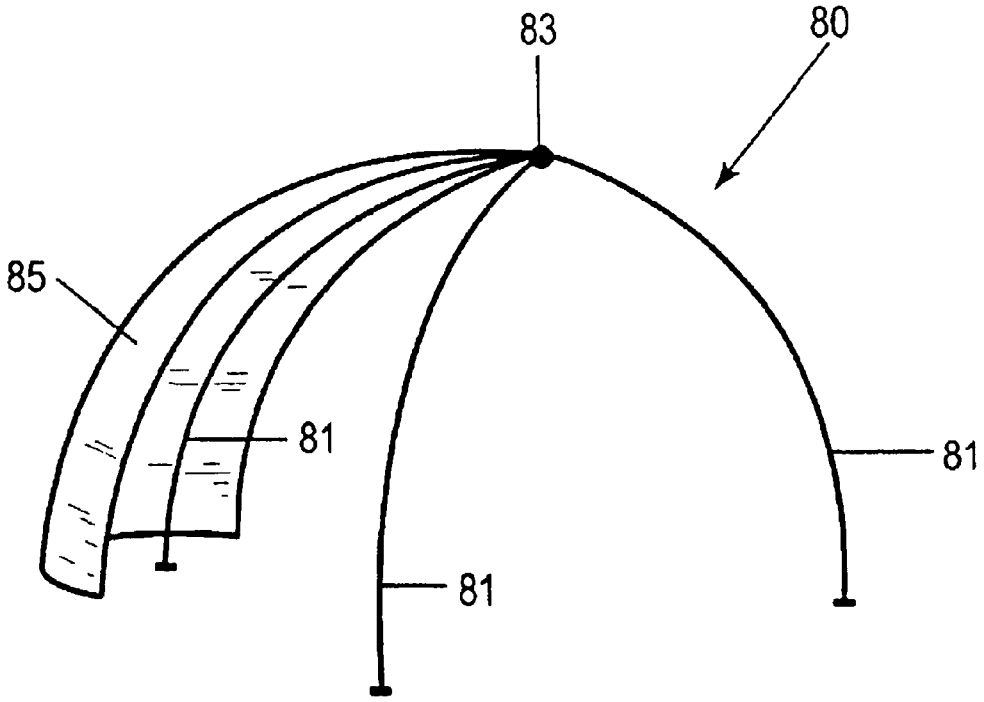
FIG. 8 illustrates the shielding assembly shown in FIG. 2 including a moveable wind shield.

FIG. 8 illustrates a particularly desirable arrangement where the shielding assembly 80 is substantially in accordance with that shown in FIGS. 2 to 7. The shield has been omitted from FIG. 8 for convenience. As shown in this Figure, the assembly 80 is provided with a wind shield 85 which is attached to the assembly 80 at the connection of the struts 81. This connection 83 advantageously facilitates rotation of the wind shield 85 about the perimeter of the assembly 80. It is envisaged that this arrangement may also be suitable for use on the assembly illustrated in FIG. 1, where the wind shield 85 would actually provide a stabilising effect to the assembly.

Referring to FIG. 9, the wind shield 95 preferably includes a central longitudinal spine 96 which extends from the top of the shield 95 to the base thereof. This spine advantageously provides improved shielding against prevailing winds as the wind is literally divided to pass around the assembly to which the shield 95 is connected. The shield assembly 95 may be reinforced if necessary with lateral supports, and may include means for securing the wind shield 95 to the ground when the wind assembly 95 is oriented in a desired position. A pivot 97 may be provided to attach the wind shield 95 to the assembly. Alternatively, the pivot is not included and the spine 96 extends to form a complete arc (as shown in broken line) which can advantageously be secured to the ground opposite the wind shield 95. That is, the wind shield may be independent of the assembly.

The construction of the shield in any case advantageously allows passage of wind therethrough at least to some extent to prevent the assembly from being blown out of position and/or blown away. This may be achieved by providing a multitude of flaps in the material of the shield which can be blown open under excessive wind conditions. Alternatively, small wind-socks or other arrangements may be used to achieve this effect. Such arrangements advantageously do not substantially compromise the light-shielding capacity of the shield.

Referring to FIG. 10, the assembly 100 includes a first arch support 101*a* and a second arch support 101*b*. These two supports 101*a*, 101*b* are each configured so that they are moveable about each other and so that each is operational and fixable about up to 180° of rotation. If the assembly is not located on the ground, but is elevated, it may be possible for a degree of rotation of greater than 180°. The shield 102 is attached at four opposing points, two on each of the supports 101*a*, 101*b*. As in earlier described embodiments, the shield 102 may be attached within or outside the supports 101*a*, 101*b*. The points of connection are movable along each of the supports 101*a*, 101*b* so that the shield 102 is positionable depending on the movement of the supports relative to each other. Thus, in this particular embodiment, the shield 102 may be moveably mounted relative to each of the supports 101*a*, 101*b*, but at any instance may be maintained in a fixed position relative to one or both of the supports 101*a*, 101*b*. The assembly 100 also preferably includes a collar 103 through which the supports 101*a*, 101*b* pass which maintains the supports at 90° positioning relative to each other. The shield 102 is further preferably provided with guides 104 for guiding movement of the shield along the supports 101*a*, 101*b*. Still further, this embodiment provides for the attachment of additional arches for shielding from wind or rain, etc. These further attachments may be located within the assembly or may be attached outside the assembly. For example, two assemblies as seen in FIG. 10 may be constructed to fit one within the other to provide shielding from both sun and wind. In this case, the two assemblies may be independent of each other or may be a single assembly with two pairs of arches, each arch of a pair having common pivot points on the ground.

Figure 11:
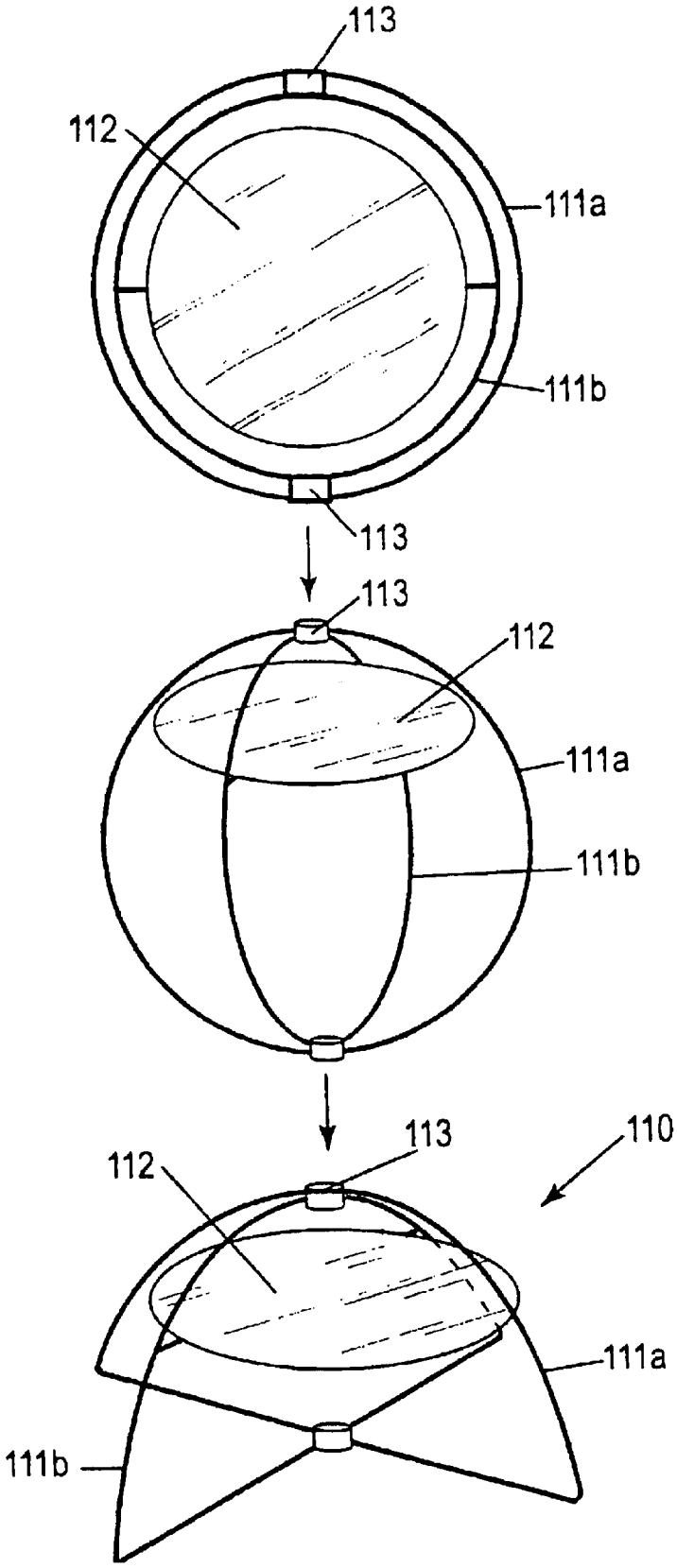
FIG. 11 illustrates a further embodiment of a collapsible assembly including, in a collapsed orientation, two concentric members and a shield which can be re-oriented to an assembled orientation as illustrated.

Turning to FIG. 11, the shielding assembly 110 is operable between a collapsed orientation (i), through an intermediate orientation (ii) to a final assembled orientation (iii). The support includes a pair of concentric members 111*a*, 111*b*, the shield 112 being attached to the inner of the concentric members 111*b*. The concentric members 111*a*, 111*b* are secured in the collapsed orientation by locks 113. On rotation of the concentric members 111*a*, 111*b* relative to each other through 90°, the shielding assembly is transformed into the intermediate orientation. The rotation of the concentric members relative to each other is facilitated by rotational movement at the locks 113. The shield 112 is also rotated about an axis so that it is positioned in a perpendicular plane relative to the planes of the concentric members 111*a*, 111*b*. From the intermediate orientation, the lower portion of the support is compressed to form a base for the support when the support is in its final assembled orientation. In this orientation, the shield is supported within the confines of the assembled support, for example by a wiring system from a central pivot point at the top of the support, or by tracking along the extending arms of the concentric members 111*a*, 111*b* in their final assembled form.

Figure 12:
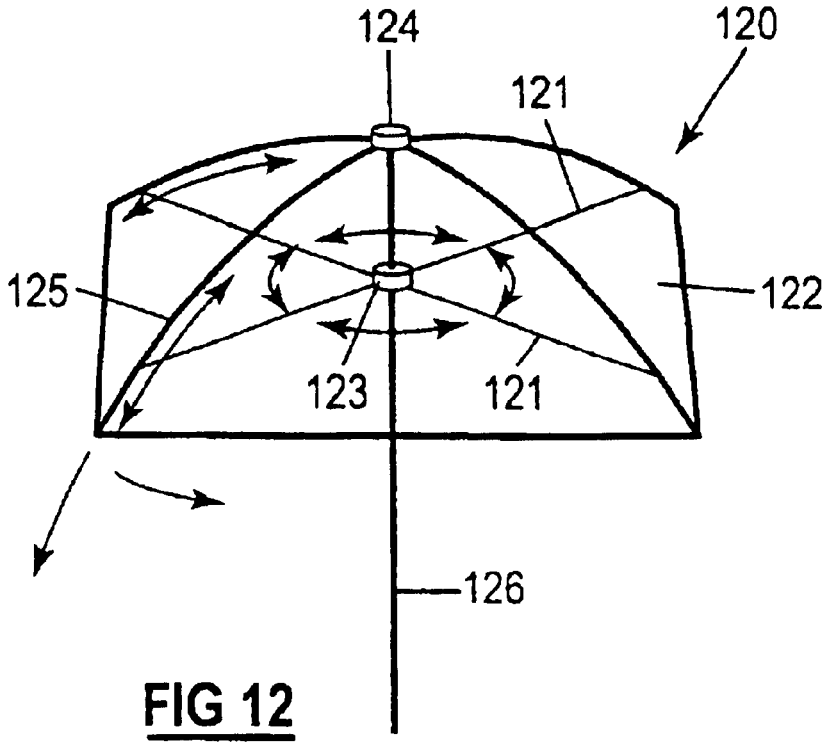
FIG. 12 illustrates yet another embodiment of the shielding assembly which substantially takes the form of an umbrella, but which includes a plurality of plurality of pivotally mounted elongate member and a central mounting member on a proximal end of an upright strut.

Referring to FIG. 12, the shielding assembly 120 may also take the appearance of an umbrella. In this case, the shielding assembly 120 includes a plurality of elongate members 121 which are moveably attached to the shield 122 and which are co-joined at pivot point 123. Al so attached to pivot point 123 is a central mounting member 124 which is fixedly attached to an inside upper point of the shield 122. The central mounting member is adapted to pivot at the pivot point 123 to provide tilting action to the shield 122. On pivoting the shield 122 moves relative to the elongate members 121. As such, the elongate members 121 track along internal tracks 125 of the shield 122. Tracking of the elongate members 121 along tracks 125 of the shield 122 is facilitated by pivotal movement of the elongate members 121 at the pivot point 123. The pivot point 123 is located at the proximal end of a support strut 126. In this embodiment, the assembly is advantageously collapsible as is a conventional umbrella.

Figure 13:
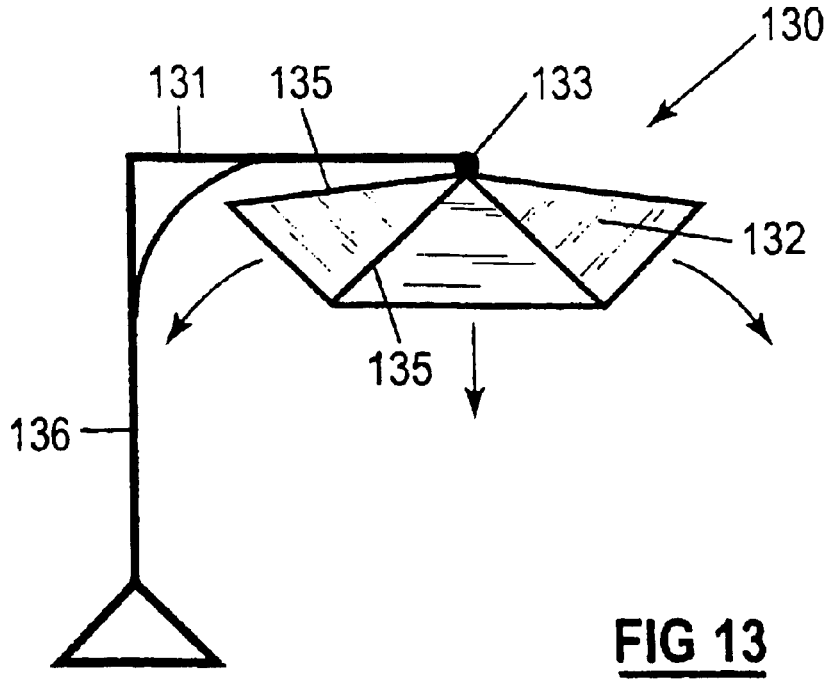
FIG. 13 illustrates an embodiment where an umbrella-like shield is pivotally and moveably mounted relative to a supporting member.

In an alternate embodiment, as illustrated in FIG. 13, an elongate member 131 of the shielding assembly 130 extends from a strut 136 and supports a shield 132. The shield 132 is supported at a pivot point 133 relative to which the shield 132 can not only pivot, but relative to which the shield is moveably mounted. In particular, the shield includes a plurality of tracks 135 relative to which the pivot point 133 is adapted to track so that the shield 132 may not only pivot about pivot point 133, but may also track relative to the pivot point 133.

The locking of the shield relative to the support in any of the above embodiments may be achieved by any suitable means. Similarly, locking of elongate members of the support relative to each other in cases where the elongate members are moveable relative to each other, may be achieved by any suitable means. For example, in either case the locking means may include clamps or ratchet type arrangements as applicable in various embodiments. However, and with reference to FIG. 14, in certain embodiments, the shielding assembly is provided with a locking mechanism 140 which includes a guide 141 which is adapted to slidably move along an elongate member of the support. More particularly, the guide 141 includes a sleeve 142 for receiving the elongate member and a clamping portion 143 for receiving a rim 144 of the shield.

The clamping portion 143 includes a hinge 145 to facilitate removal and insertion of the rim 144, and also includes a cylindrical slot 146 and a bearing ball 147 which engages the rim 144 of the shield. The ball 147, which may optionally be replaced by a bearing surface of the clamping portion 143, is positioned for engagement with the rim 144, the ball 147 being kept in place vertically by removable cylinders insertable in cylinder slots 146.

The rim 144 includes a central portion 148 which, when the shield is in a locked position, engages the ball. The central portion 148 includes a ridged surface for engagement with the ball such that transverse movement of the shield relative to the ball when the ball is engaged by the central portion 148 is prevented. As it is necessary for lateral movement of the shield for there to be transverse movement, the transverse locking of the central portion 148 prevents any lateral movement of the shield relative to the support. When movement of the shield is desired, a user simply disengages the central portion 148 from engagement with the ball in which case foam portions 149 of the rim 144 are compressed (as shown in broken line), the central portion 148 being displaced vertically relative to the ball. When the shield has been moved to a desired orientation and the user of the assembly stops applying force to the shield, the shield returns to its locked position where the central portion 148 is in engagement with the ball. Thus, automatic locking of the shield relative to the support is facilitated. The inner surface of the clamping portion 143 is advantageously a low friction surface to facilitate each tracking of the rim 144. Alternatively, the locking mechanism may be provided with a disengaging mechanism which acts to disengage the engaging surface of the clamping portion 143 on the rim. For example, the disengaging mechanism may include a ring which is mounted on each of the locking mechanisms and is moveable from an engaging position to a disengaging position whereby movement from the engaging to disengaging position retracts the engaging surface of respective clamping portions 143.

Throughout this specification and the claims which follow, unless the context requires otherwise, the word "comprise", and variations such as "comprises" and "comprising", will be understood to imply the inclusion of a stated integer or group of integers or steps but not the exclusion of any other integer or group of integers or steps.

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in this specification, individually or collectively, and any and all combinations of any two or more of said steps or features.

What is claimed is:

1. A shielding assembly comprising:

at least first and second elongate members, each of said members joinable together at a common point;

a shield, movably mountable adjacent said shielding assembly and movable in three dimensions relative to said shielding assembly so as to shield a user of said shielding assembly, and at least a third elongate member that forms a frame with the first and second elongate members, said shield being movably mounted relative to the first, second, and third elongate members adjacent said frame;

wherein said shield is mounted for longitudinal and transverse movement relative to each of the first, second, and third elongate members.

2. The shielding assembly according to claim 1, wherein said shield is mounted within said frame.

3. The shielding assembly according to claim 1, wherein said shield is lockable relative to at least one said elongate member.

4. The shielding assembly according to claim 1, wherein said shield is moveably mountable adjacent said assembly at a region lower than said common point.

* * * * *